US011098271B2

(12) United States Patent
Piorkowski

(10) Patent No.: US 11,098,271 B2
(45) Date of Patent: Aug. 24, 2021

(54) SALT-FREE STRUCTURED UNIT DOSE SYSTEMS

(71) Applicant: Henkel IP & Holding GmbH, Duesseldorf (DE)

(72) Inventor: Daniel T. Piorkowski, Fairfield, CT (US)

(73) Assignee: Henkel IP & Holding GmbH, Duesseldorf (DE)

( * ) Notice: Subject to any disclaimer, the term of this patent is extended or adjusted under 35 U.S.C. 154(b) by 92 days.

(21) Appl. No.: 16/438,700

(22) Filed: Jun. 12, 2019

(65) Prior Publication Data

US 2020/0392435 A1 Dec. 17, 2020

(51) Int. Cl.

| | |
|---|---|
| ***C11D 17/04*** | (2006.01) |
| ***C11D 17/00*** | (2006.01) |
| ***C11D 1/04*** | (2006.01) |
| ***C11D 1/22*** | (2006.01) |
| ***C11D 1/29*** | (2006.01) |
| ***C11D 1/72*** | (2006.01) |
| ***C11D 1/83*** | (2006.01) |
| ***C11D 3/20*** | (2006.01) |
| ***C11D 3/37*** | (2006.01) |
| ***C11D 3/43*** | (2006.01) |
| ***C11D 3/04*** | (2006.01) |

(52) U.S. Cl.

CPC ..... *C11D 17/043* (2013.01); *C11D 1/83* (2013.01); *C11D 3/046* (2013.01); *C11D 3/2086* (2013.01); *C11D 3/3707* (2013.01); *C11D 3/3723* (2013.01); *C11D 3/43* (2013.01); *C11D 17/0026* (2013.01); *C11D 1/22* (2013.01)

(58) Field of Classification Search

None

See application file for complete search history.

(56) References Cited

U.S. PATENT DOCUMENTS

| | | | |
|---|---|---|---|
| 3,218,776 | A | 11/1965 | Cloud |
| 3,308,067 | A | 3/1967 | Diehl |
| 3,453,779 | A | 7/1969 | Reifenberg |
| 4,663,071 | A | 5/1987 | Bush et al. |
| 4,776,455 | A | 10/1988 | Anderson et al. |
| 4,793,416 | A | 12/1988 | Mitchell |
| 5,616,781 | A | 4/1997 | Sajic et al. |
| 5,699,653 | A | 12/1997 | Hartman et al. |
| 5,722,217 | A | 3/1998 | Cloud |
| 5,958,864 | A | 9/1999 | Artiga Gonzalez et al. |
| 6,024,943 | A | 2/2000 | Ness et al. |
| 6,037,319 | A | 3/2000 | Dickler et al. |
| 6,056,949 | A | 5/2000 | Menzi et al. |
| 6,194,375 | B1 | 2/2001 | Ness et al. |
| 6,458,754 | B1 | 10/2002 | Velazquez et al. |
| 6,727,215 | B2 | 4/2004 | Roberts et al. |
| 6,764,992 | B2 | 7/2004 | Kumar et al. |
| 6,878,679 | B2 | 4/2005 | Sommerville-Roberts et al. |
| 7,259,134 | B2 | 8/2007 | Beckholt et al. |
| 7,282,472 | B2 | 10/2007 | Kapur et al. |
| 7,304,025 | B2 | 12/2007 | Hardy et al. |
| 7,329,441 | B2 | 2/2008 | Catlin et al. |
| 7,439,215 | B2 | 10/2008 | Catlin et al. |
| 7,464,519 | B2 | 12/2008 | Fisher et al. |
| 7,563,757 | B2 | 7/2009 | Kouvroukoglou et al. |
| 7,595,290 | B2 | 9/2009 | Pounds et al. |
| 8,426,353 | B2 | 4/2013 | Ouali et al. |
| 2011/0061174 | A1 | 3/2011 | Boutique |
| 2011/0224127 | A1 | 9/2011 | Blyth et al. |
| 2013/0065811 | A1* | 3/2013 | Fernandez-Prieto ..... C11D 17/003 510/375 |
| 2014/0274859 | A1 | 9/2014 | Adamy |
| 2015/0329807 | A1* | 11/2015 | Naqvi ..... C11D 3/2041 206/524.7 |
| 2016/0040099 | A1 | 2/2016 | Maes |
| 2016/0068785 | A1* | 3/2016 | Vinson ..... C11D 3/386 510/295 |
| 2016/0340611 | A1* | 11/2016 | Scheibel ..... C11D 1/22 |
| 2016/0340625 | A1* | 11/2016 | Scheibel ..... C11D 1/146 |
| 2018/0216031 | A1* | 8/2018 | Cron ..... C11D 1/22 |
| 2018/0216033 | A1 | 8/2018 | Camire et al. |
| 2018/0216034 | A1 | 8/2018 | Camire et al. |
| 2018/0312788 | A1 | 11/2018 | Naqvi |
| 2018/0320109 | A1 | 11/2018 | Boutique |
| 2019/0017001 | A1* | 1/2019 | Camire ..... C11D 3/37 |

FOREIGN PATENT DOCUMENTS

| | | | |
|---|---|---|---|
| EP | 193360 | A2 | 9/1986 |
| WO | 9532997 | A1 | 12/1995 |

(Continued)

OTHER PUBLICATIONS

European Search Report EP Application No. 20179271 Completed: Oct. 21, 2020 dated Oct. 29, 2020 10 Pages.

*Primary Examiner* — Lorna M Douyon

(74) *Attorney, Agent, or Firm* — Bojuan Deng

(57) ABSTRACT

A unit dose detergent pack includes a pouch and a structured detergent composition encapsulated within the pouch. The structured detergent composition includes a surfactant component including an alcohol ethoxy sulfate having a $C_8$-$C_{20}$ backbone that is ethoxylated with from about 1 to about 10 moles of ethylene oxide, a linear alkyl benzene sulfonate, a $C_8$-$C_{20}$ alcohol alkoxylated with about 2 to about 12 moles of an alkylene oxide, water and a non-aqueous solvent component. The structured detergent composition is free of an added rheology modifier. A combination of the surfactant component and the non-aqueous solvent component is present in a weight ratio of actives with a total amount of water of from about 1:0.4 to about 1:0.75 such that the structured detergent composition has a viscosity of at least about 100 Pa.s.

18 Claims, 2 Drawing Sheets

(56) References Cited

FOREIGN PATENT DOCUMENTS

| | | | |
|---|---|---|---|
| WO | 2010069957 | A1 | 6/2010 |
| WO | 2013075913 | A1 | 5/2013 |

* cited by examiner

SALT-FREE STRUCTURED UNIT DOSE SYSTEMS

FIELD OF THE INVENTION

The present disclosure generally relates to a unit dose pack that includes a structured detergent composition, and methods of forming both the composition and the pack. More specifically, the disclosure relates to inclusion of a surfactant component and water in a particular weight ratio which facilitates formation of a structured detergent composition having a viscosity of at least about 100 Pa·s.

BACKGROUND OF THE INVENTION

Many current structured detergent compositions include rheology control agents such as salts, alkoxylated polyethyleneimines, polyethylene glycol, ionic liquids, and the like. These rheology control agents can add extra time, cost, and complexities to the commercial process. Some structured detergent compositions also contain large amounts of surfactants which also increases costs. Moreover, depending on the type of surfactant used, some surfactants promote reduction in viscosity which makes structuring more difficult. Other types of surfactants have negative interactions with films used to form unit dose packs, such as polyvinyl alcohol (PVOH). This can cause instability in the packs and reduce their usefulness. Accordingly, there remains an opportunity for improvement. Furthermore, other desirable features and characteristics of the present disclosure will become apparent from the subsequent detailed description of the disclosure and the appended claims, taken in conjunction this background of the disclosure.

BRIEF SUMMARY OF THE INVENTION

This disclosure provides a unit dose detergent pack including a pouch made of a water-soluble film and a structured detergent composition encapsulated within the pouch. The structured detergent composition includes a surfactant component including an alcohol ethoxy sulfate having a $C_8$-$C_{20}$ backbone that is ethoxylated with from about 1 to about 10 moles of ethylene oxide and is present in an amount of from about 5 to about 20 weight percent actives based on a total weight of the structured detergent composition. The structured detergent composition also includes a linear alkyl benzene sulfonate present in an amount of from about 1 to about 10 weight percent actives based on a total weight of the structured detergent composition. The structured detergent composition also includes a $C_8$-$C_{20}$ alcohol alkoxylated with about 2 to about 12 moles of an alkylene oxide and present in an amount of from about 7 to about 30 weight percent actives based on a total weight of the structured detergent composition. The structured detergent composition further includes water and a non-aqueous solvent component. The structured detergent composition is free of an added rheology modifier. Moreover, a combination of the surfactant component and the non-aqueous solvent component is present in a weight ratio of actives with a total amount of water of from about 1:0.4 to about 1:0.75 such that the structured detergent composition has a viscosity of at least about 100 Pa·s measured using an AR2000-EX Rheometer at a shear rate of 1.08 l/s over 5 minutes at 20° C. with a geometry cone of 40 mm, 1:59:49 degree:min:sec, and a truncation gap of 52 microns. In some embodiments, the non-aqueous solvent component is not alkoxylated polyethyleneimines, polyethylene glycol, ionic liquids, or combinations thereof.

This disclosure also provides the structured detergent composition itself.

This disclosure further provides a method for modifying rheology of the structured detergent composition. The method includes the step of providing a detergent composition that includes the aforementioned surfactant component, water, and the non-aqueous solvent. The method also includes the step of diluting the detergent composition with additional water such that the combination of the surfactant component and the non-aqueous solvent component is present in a weight ratio of actives with a total amount of water of from about 1:0.4 to about 1:0.75 such that the detergent composition is structured and has a viscosity of at least about 100 Pa·s measured using an AR2000-EX Rheometer at a shear rate of 1.08 l/s over 5 minutes at 20° C. with a geometry cone of 40 mm, 1:59:49 degree:min:sec, and a truncation gap of 52 microns.

The structured detergent composition exhibits superior and unexpected results. More specifically, the combination of the surfactant component and non-aqueous solvent along with the water, in a particular weight ratio, surprisingly increases the viscosity of the structured detergent composition which, in turn, allows for less surfactant to be used and greater units dose pack stability to be realized. This unexpected viscosity increase can minimize pack dissolution and premature dissolution, can minimize pack fusion with other packs, can minimized leaks, and can optimize dissolution profiles. Moreover, simplified formulations can be produced. This allows the packs to be used in a wider variety of environments.

Without wishing to be bound by theory, it is believed that by utilizing the combination of the surfactant component, non-aqueous solvent, and the water in the particular weight ratio, the structured detergent composition shows a trend of maximizing viscosity and pack stability simultaneously. Both are advantageous for dissolution of the unit dose detergent product when it is used in a washing machine.

BRIEF DESCRIPTION OF THE DRAWINGS

The present disclosure will hereinafter be described in conjunction with the following Figures, wherein.

DETAILED DESCRIPTION OF THE INVENTION

Figure 1:
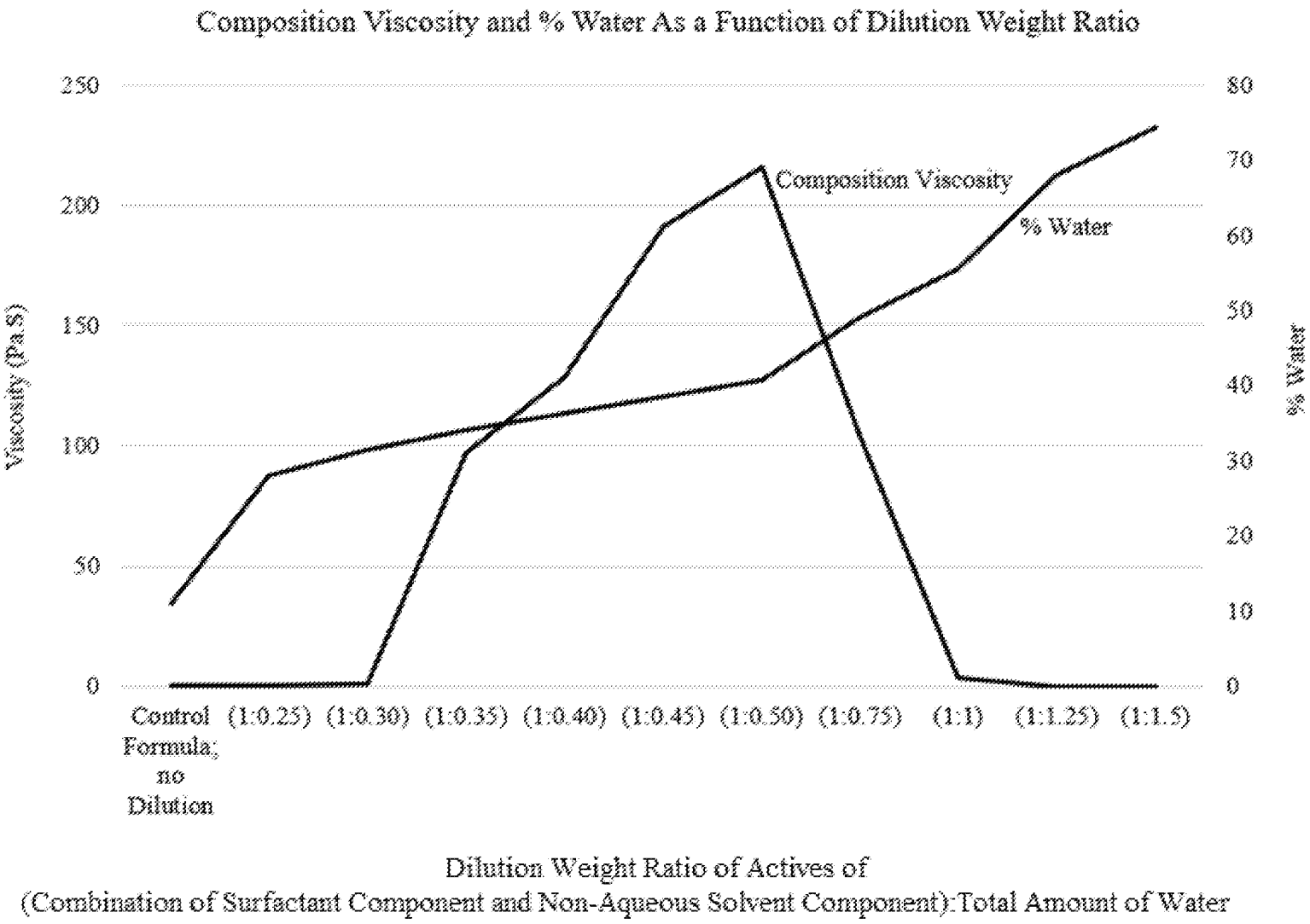
FIG. 1 is a line graph of Composition Viscosity and Percent Water as a Function of Dilution Weight Ratio of Actives of a (Combination of the Surfactant Component and the Non-Aqueous Solvent Component):Total Amount of Water, as set forth in the Examples.

The following detailed description is merely exemplary in nature and is not intended to limit the disclosure. Furthermore, there is no intention to be bound by any theory presented in the preceding background or the following detailed description.

Embodiments of the present disclosure are generally directed to structured detergent compositions and methods for forming the same. For the sake of brevity, conventional techniques related to structured detergent compositions may not be described in detail herein. Moreover, the various tasks and process steps described herein may be incorporated into a more comprehensive procedure or process having additional steps or functionality not described in detail herein. In particular, various steps in the manufacture of structured detergent compositions are well-known and so, in the interest of brevity, many conventional steps will only be mentioned briefly herein or will be omitted entirely without providing the well-known process details.

In one aspect, the present disclosure provides a structured detergent composition with a consistent, high viscosity profile upon dilution. The structured detergent composition may comprise a surfactant component, water, and a non-aqueous solvent component, as described in detail below. In some embodiments, the non-aqueous solvent component is not alkoxylated polyethyleneimines, polyethylene glycol, ionic liquids, or combinations thereof. The particular weight ratio of a combination of the surfactant component and the non-aqueous solvent component with the water surprisingly increases the viscosity of the composition thereby structuring the composition and forming the structured detergent composition. The structured detergent composition may be used in a unit dose pack detergent product.

While not wishing to be bound by the theory, it is believed that the structured surfactant system prevents water from migrating out of the system to weaken or dissolve a water-soluble film that encloses the system. As such, the structured surfactant system increases the overall stability of a unit dose composition and allows for a higher water content in a unit dose pack. The structured surfactant system is not a solid, and does not rapidly separate, or solidify when it is diluted with water. These properties lead to its versatile applications.

In another aspect, the present disclosure provides a method for modifying rheology of a detergent composition, i.e., modifying the viscosity to structure the detergent composition and form a structured detergent composition. The method includes the step of providing a detergent composition that includes the aforementioned surfactant component, water, and non-aqueous solvent component. The method also includes the step of diluting the detergent composition with additional water such that a combination of the surfactant component and the non-aqueous solvent component is present in a weight ratio of actives with a total amount of water of from about 1:0.4 to about 1:0.75 such that the detergent composition is structured and has a viscosity of at least about 100 Pa·s measured using an AR2000-EX Rheometer at a shear rate of 1.08 l/s over 5 minutes at 20° C. with a geometry cone of 40 mm, 1:59:49 degree:min:sec, and a truncation gap of 52 microns.

It was unexpectedly discovered that, as a result of utilizing the particular dilution weight ratio, the detergent composition increases in viscosity and becomes structured. More specifically, the combination of the surfactant component, non-aqueous solvent, and the water in the particular weight ratio surprisingly increases the viscosity of the structured detergent composition which, in turn, allows for less surfactant to be used and greater units dose pack stability to be realized. This unexpected viscosity increase can minimize pack dissolution and premature dissolution, can minimize pack fusion with other packs, can minimized leaks, and can optimize dissolution profiles. Moreover, simplified formulations can be produced. This allows the packs to be used in a wider variety of environments.

Without wishing to be bound by theory, it is believed that by utilizing the combination of the surfactant component, non-aqueous solvent, and the water in the particular weight ratio, the structured detergent composition shows a trend of maximizing viscosity and pack stability simultaneously. Both are advantageous for dissolution of the unit dose detergent product when it is used in a washing machine.

Unit Dose Pack:

This disclosure provides a unit dose pack that includes a pouch made of a water-soluble film and a structured detergent composition encapsulated within the pouch, each as described below.

A unit dose pack can be formed by encapsulating the structured detergent composition within the pouch, wherein the pouch includes a film. In some embodiments, the film forms one half or more of the pouch, where the pouch may also include dyes or other components. In some embodiments, the film is water soluble such that the film will completely dissolve when an exterior of the film is exposed to water, such as in a washing machine typically used for laundry. When the film dissolves, the pouch is ruptured and the contents are released. As used herein, "water soluble" means at least 2 grams of the solute (the film in one example) will dissolve in 5 liters of solvent (water in one example,) for a solubility of at least 0.4 grams per liter (g/l), at a temperature of 25 degrees Celsius (° C.) unless otherwise specified. Suitable films for packaging are completely soluble in water at temperatures of about 5° C. or greater.

In various embodiments, the film is desirably strong, flexible, shock resistant, and non-tacky during storage at both high and low temperatures and high and low humidities. In one embodiment, the film is initially formed from polyvinyl acetate, and at least a portion of the acetate functional groups are hydrolyzed to produce alcohol groups. The film may include polyvinyl alcohol (PVOH), and may include a higher concentration of PVOH than polyvinyl acetate. Such films are commercially available with various levels of hydrolysis, and thus various concentrations of PVOH, and in an exemplary embodiment the film initially has about 85 percent of the acetate groups hydrolyzed to alcohol groups. Some of the acetate groups may further hydrolyze in use, so the final concentration of alcohol groups may be higher than the concentration at the time of packaging. The film may have a thickness of from about 25 to about 200 microns (μm), or from about 45 to about 100 μm, or from about 70 to about 90 μm in various embodiments. The film may include alternate materials in some embodiments, such as methyl hydroxy propyl cellulose and polyethylene oxide. In various non-limiting embodiments, all values, both whole and fractional, between and including all of the above, are hereby expressly contemplated for use herein.

The unit dose pack may be formed from a pouch having a single section, but the unit dose pack may be formed from pouches with two or more different sections in alternate embodiments. In embodiments with a pouch having two or more sections, the contents of the different sections may or may not be the same.

Detergent Composition and Structured Detergent Composition.

This disclosure provides a detergent composition both before and after structuring or, both structured and non-structured. Before structuring, the composition may be described as a detergent composition or as an unstructured detergent composition. After structuring, the composition may be described as a structured detergent composition. Typically, the difference between the detergent composition and the structured detergent composition, relative to this disclosure, is the amount of water that is included. As is described in greater detail below, the detergent composition becomes structured at a particular dilution. Within this range, the composition is structured and has a certain viscosity. At levels above and below that range, the viscosity is shown to be low thereby indicating that the composition is not structured.

The detergent composition and/or structured detergent composition may be, include, consist essentially of, or consist of, a surfactant component, water, and a non-aqueous solvent component. The detergent composition and/or structured detergent composition is free of an added rheology modifier.

In various embodiments, the detergent composition and/or structured detergent composition may be, include, consist essentially of, or consist of, a surfactant component including an alcohol ethoxy sulfate, a linear alkyl benzene sulfonate, and a $C_8$-$C_{20}$ alkoxylated alcohol, water, and a non-aqueous solvent component. Again, the detergent composition and/or structured detergent composition is free of an added rheology modifier.

In one embodiment, the detergent composition and/or structured detergent composition comprises a surfactant component including an alcohol ethoxy sulfate, a linear alkyl benzene sulfonate, and a $C_8$-$C_{20}$ alkoxylated alcohol, water, and a non-aqueous solvent component. In this embodiment, the detergent composition and/or structured detergent composition is free of an added rheology modifier.

In another embodiment, the detergent composition and/or structured detergent composition consists essentially of a surfactant component including an alcohol ethoxy sulfate, a linear alkyl benzene sulfonate, and a $C_8$-$C_{20}$ alkoxylated alcohol, water, and a non-aqueous solvent component. In this embodiment, the detergent composition and/or structured detergent composition is free of an added rheology modifier.

In still another embodiment, the detergent composition and/or structured detergent composition consists of a surfactant component including an alcohol ethoxy sulfate, a linear alkyl benzene sulfonate, and a $C_8$-$C_{20}$ alkoxylated alcohol, water, and a non-aqueous solvent component. In this embodiment, the detergent composition and/or structured detergent composition is free of an added rheology modifier.

In various embodiments, the detergent composition and/or structured detergent composition may be, include, consist essentially of, or consist of, a surfactant component including an alcohol ethoxy sulfate having a $C_8$-$C_{20}$ backbone that is ethoxylated with from about 1 to about 10 moles of ethylene oxide and present in an amount of from about 5 to about 20 weight percent actives based on a total weight of the structured detergent composition, a linear alkyl benzene sulfonate present in an amount of from about 1 to about 10 weight percent actives based on a total weight of the structured detergent composition, $C_8$-$C_{20}$ alcohol alkoxylated with about 2 to about 12 moles of an alkylene oxide and present in an amount of from about 7 to about 30 weight percent actives based on a total weight of the structured detergent composition, water, and a non-aqueous solvent component. Again, the detergent composition and/or structured detergent composition is free of an added rheology modifier.

In one embodiment, the detergent composition and/or structured detergent composition comprises a surfactant component including an alcohol ethoxy sulfate having a $C_8$-$C_{20}$ backbone that is ethoxylated with from about 1 to about 10 moles of ethylene oxide and present in an amount of from about 5 to about 20 weight percent actives based on a total weight of the structured detergent composition, a linear alkyl benzene sulfonate present in an amount of from about 1 to about 10 weight percent actives based on a total weight of the structured detergent composition, $C_8$-$C_{20}$ alcohol alkoxylated with about 2 to about 12 moles of an alkylene oxide and present in an amount of from about 7 to about 30 weight percent actives based on a total weight of the structured detergent composition, water, and a non-aqueous solvent component. Again, the detergent composition and/or structured detergent composition is free of an added rheology modifier.

In another embodiment, the detergent composition and/or structured detergent composition consists essentially of a surfactant component including an alcohol ethoxy sulfate having a $C_8$-$C_{20}$ backbone that is ethoxylated with from about 1 to about 10 moles of ethylene oxide and present in an amount of from about 5 to about 20 weight percent actives based on a total weight of the structured detergent composition, a linear alkyl benzene sulfonate present in an amount of from about 1 to about 10 weight percent actives based on a total weight of the structured detergent composition, $C_8$-$C_{20}$ alcohol alkoxylated with about 2 to about 12 moles of an alkylene oxide and present in an amount of from about 7 to about 30 weight percent actives based on a total weight of the structured detergent composition, water, and a non-aqueous solvent component. Again, the detergent composition and/or structured detergent composition is free of an added rheology modifier.

In a further embodiment, the detergent composition and/or structured detergent composition consists of a surfactant component including an alcohol ethoxy sulfate having a $C_8$-$C_{20}$ backbone that is ethoxylated with from about 1 to about 10 moles of ethylene oxide and present in an amount of from about 5 to about 20 weight percent actives based on a total weight of the structured detergent composition, a linear alkyl benzene sulfonate present in an amount of from about 1 to about 10 weight percent actives based on a total weight of the structured detergent composition, $C_8$-$C_{20}$ alcohol alkoxylated with about 2 to about 12 moles of an alkylene oxide and present in an amount of from about 7 to about 30 weight percent actives based on a total weight of the structured detergent composition, water, and a non-aqueous solvent component. Again, the detergent composition and/or structured detergent composition is free of an added rheology modifier.

In still other embodiments, the detergent composition and/or structured detergent composition may comprise, consist essentially of, or consist of, any combination of components described herein, in any amounts described herein.

In further embodiments, the detergent composition and/or structured detergent composition is free of, or includes less than 0.1, less than 0.05, less than 0.01, or 0 weight percent of, any one or more of the optional components or additives described below and/or those such as, but not limited to, surfactants other than those of the surfactant component described above, aqueous solvents such as alcohols, fillers, polymers, etc.

Surfactant Component

As first introduced above, the detergent composition and/or structured detergent composition includes the surfactant component. The surfactant component may be, include, consist essentially of, or consist of, an alcohol ethoxy sulfate, a linear alkyl benzene sulfonate, and a $C_8$-$C_{20}$ alkoxylated alcohol, each described in greater detail below. The surfactant component may include one or more than one of each of the aforementioned surfactant types.

Alcohol Ethoxy Sulfate

The surfactant component includes the alcohol ethoxy sulfate, which may be described as an anionic surfactant.

The alcohol ethoxy sulfate has a $C_8$-$C_{20}$ backbone that is ethoxylated with from about 1 to about 10 moles of ethylene oxide. Alternatively, the alcohol ethoxy sulfate may be described as having a $C_8$-$C_{20}$ backbone and about 1 to 10 moles of ethylene oxide units bonded thereto. The metal may be any metal but is typically sodium or potassium. The backbone of the surfactant component may have any number of carbon atoms from 8 to 20, e.g. 10 to 18, 12 to 16, 12 to 14, 14 to 16, or 8, 9, 10, 11, 12, 13, 14, 15, 16, 17, 18, 19, or 20, carbon atoms. Various mixtures of alcohol ethoxy sulfates may also be used wherein different length backbones are utilized. The backbone is ethoxylated with from about 1 to about 10, about 2 to about 9, about 3 to about 8, about 4 to about 7, about 5 to about 6, or 1, 2, 3, 4, 5, 6, 7, 8, 9, or 10, moles of ethylene oxide.

In various embodiments, the alcohol ethoxy sulfate is further defined as sodium laureth sulfate (SLES) having the formula: $CH_3(CH_2)_{10}CH_2(OCH_2CH_2)_nOSO_3Na$ wherein n is from about 1 to about 10. In another embodiment, the alcohol ethoxy sulfate is sodium laureth sulfate ethoxylated with about 2 to about 4 moles of ethylene oxide.

The alcohol ethoxy sulfate is present in an amount of from about 5 to about 20, about 10 to about 20, about 10 to about 15, about 15 to about 20, or about 5, about 10, about 15 (e.g. about 15.6), or about 20, weight percent actives based on a total weight of the composition. In various embodiments, the alcohol ethoxy sulfate is present in an amount of about 15 to about 16, about 15 to about 17, or about 14 to about 16, weight percent actives based on a total weight of the composition. In various non-limiting embodiments, all values, both whole and fractional, between and including all of the above, are hereby expressly contemplated for use herein.

Linear Alkylbenzene Sulfonate

The surfactant component also includes the linear alkylbenzene sulfonate (LAS). The linear alkylbenzene sulfonate may have a linear alkyl chain that has, e.g. 10 to 13 carbon atoms. These carbon atoms are present in approximately the following mole ratios C10:C11:C12:C13 is about 13:30:33:24 having an average carbon number of about 11.6 and a content of the most hydrophobic 2-phenyl isomers of about 18-29 wt %. The linear alkylbenzene sulfonate may be any known in the art. The linear alkylbenzene sulfonate (LAS), may be present in an amount of about 1 to about 10, about 5 to about 10, about 1 to about 5, about 1, 2, 3, 4, 5, 6, 7, 8, 9, or 10, or about 4 to about 6, about 4 to about 5, or about 5 to about 6, weight percent actives based on a total weight of the composition. In various non-limiting embodiments, all values, both whole and fractional, between and including all of the above, are hereby expressly contemplated for use herein.

Alkoxylated Alcohol

The surfactant component also includes a $C_8$-$C_{20}$ alkoxylated alcohol, which may be described as an alcohol alkoxylate or as a non-ionic surfactant. The $C_8$-$C_{20}$ alcohol is capped with (or comprises), or is alkoxylated with, approximately 2 to 12 moles of an alkylene oxide. In other embodiments, the alcohol alkoxylate has from 8 to 20, 10 to 18, 12 to 16, or 12 to 14, carbon atoms and is an ethoxylate, propoxylate, or butoxylate and is capped with an alkylene oxide, e.g. ethylene oxide, propylene oxide, or butylene oxide. The alcohol alkoxylate may be capped with varying numbers of moles of the alkylene oxide, e.g. about 2 to about 12, about 3 to about 11, about 4 to about 10, about 5 to about 9, about 6 to about 8, or about 7 to about 8, moles. In various non-limiting embodiments, all values, both whole and fractional, between and including all of the above, are hereby expressly contemplated for use herein.

The alkoxylated alcohol may be present in an amount of from greater than about 7 to about 30, e.g. about 7 to about 30, about 10 to about 30, about 15 to about 30, about 7 to about 25, about 10 to about 20, about 15 to about 20, about 15 to about 25, about 15 to about 30, about 20 to about 25, about 25 to about 30, about 20 to about 30, about 15 to about 25, about 20, 21, 22, 23, 24, 25, etc., weight percent actives based on a total weight of the composition. In various non-limiting embodiments, all values, both whole and fractional, between and including all of the above, are hereby expressly contemplated for use herein.

Additional Surfactants:

The detergent composition and/or structured detergent composition may also include one or more additional surfactants. The one or more additional surfactants may be part of the surfactant component, as described above, or may be independent from the surfactant component. In various embodiments, the one or more additional surfactants is or includes an additional anionic surfactant and/or a non-ionic surfactant. However, other surfactants such as cationic and/or zwitterionic (amphoteric) surfactants may also be utilized or may be excluded from the detergent composition and/or structured detergent composition.

In other embodiments, the one or more additional surfactants may be or include anionic surfactants which include soaps which contain sulfate or sulfonate groups, including those with alkali metal ions as cations, can be used. Usable soaps include alkali metal salts of saturated or unsaturated fatty acids with 12 to 18 carbon (C) atoms. Such fatty acids may also be used in incompletely neutralized form. Usable ionic surfactants of the sulfate type include the salts of sulfuric acid semi esters of fatty alcohols with 12 to 18 C atoms. Usable ionic surfactants of the sulfonate type include alkane sulfonates with 12 to 18 C atoms and olefin sulfonates with 12 to 18 C atoms, such as those that arise from the reaction of corresponding mono-olefins with sulfur trioxide, alpha-sulfofatty acid esters such as those that arise from the sulfonation of fatty acid methyl or ethyl esters. In various non-limiting embodiments, all values, both whole and fractional, between and including all of the above, are hereby expressly contemplated for use herein.

Other suitable examples of additional nonionic surfactants include alkyl glycosides and ethoxylation and/or propoxylation products of alkyl glycosides or linear or branched alcohols in each case having 12 to 18 carbon atoms in the alkyl moiety and 3 to 20, or 4 to 10, alkyl ether groups. Corresponding ethoxylation and/or propoxylation products of N-alkylamines, vicinal diols, and fatty acid amides, which correspond to the alkyl moiety in the stated long-chain alcohol derivatives, may furthermore be used. Alkylphenols having 5 to 12 carbon atoms may also be used in the alkyl moiety of the above described long-chain alcohol derivatives. In various non-limiting embodiments, all values, both whole and fractional, between and including all of the above, are hereby expressly contemplated for use herein.

In other embodiments, the additional surfactant is chosen from nonionic and ionic surfactants, such as alkoxylates, polyglycerols, glycol ethers, glycols, polyethylene glycols, polypropylene glycols, polybutylene glycols, glycerol ester ethoxylates, polysorbates, alkyl ether sulfates, alkyl- and/or arylsulfonates, alkyl sulfates, ester sulfonates (sulfo-fatty acid esters), ligninsulfonates, fatty acid cyanamides, anionic sulfosuccinic acid surfactants, fatty acid isethionates, acylaminoalkane-sulfonates (fatty acid taurides), fatty acid sarcosinates, ether carboxylic acids and alkyl(ether)phosphates. In such embodiments, suitable nonionic surfactants include $C_2$-$C_6$-alkylene glycols and poly-$C_2$-$C_3$-alkylene glycol ethers, optionally, etherified on one side with a $C_1$-$C_6$-alkanol and having, on average, 1 to 9 identical or different, typically identical, alkylene glycol groups per molecule, and also alcohols and fatty alcohol polyglycol ethers, typically propylene glycol, dipropylene glycol, trimethylolpropane, and fatty alcohols with low degrees of ethoxylation having 6 to 22, typically 8 to 18, more typically 8 to 12, and even more typically 8 to 11, carbon atoms. Moreover, suitable ionic surfactants include alkyl ether sulfates, sulfosuccinic acid surfactants, polyacrylates and phosphonic acids, typically lauryl sulfate, lauryl ether sulfate, sodium sulfosuccinic acid diisooctyl ester, 1-hydroxyethane-1,1-diphosphonic acid, and diacetyltartaric esters. In various non-limiting embodiments, all values, both whole and fractional, between and including all of the above, are hereby expressly contemplated for use herein.

Water:

Water is present in the detergent composition and/or structured detergent composition in varying amounts. Typically, water is present in the detergent (unstructured) composition in an amount that is less than an amount of water present in the structured detergent composition. However, it is also contemplated that the water may be present in the detergent (unstructured) composition in an amount that is greater than an amount of water present in the structured detergent composition. More specifically, a combination of the surfactant component and the non-aqueous solvent component is present in a weight ratio of actives with a total amount of water of from about 1:0.4 to about 1:0.75 such that the structured detergent composition has a viscosity of at least about 100 Pa·s measured using an AR2000-EX Rheometer at a shear rate of 1.08 l/s over 5 minutes at 20° C. with a geometry cone of 40 mm, 1:59:49 degree:min:sec, and a truncation gap of 52 microns. In other words, (the surfactant component+ the non-aqueous solvent component) is present in a weight ratio of actives with (a total weight of water), i.e., [weight of (the actives surfactant component+ the actives of the non-aqueous solvent component)]: [total weight of the (water)], of from about 1:0.4 to about 1:0.75. In weight ratios above and below these values, the composition has a viscosity that is less than about 100 Pa·s. For that reason, at weight ratios above and below these values, the composition is considered to be unstructured. In various embodiments, the weight ratios and viscosities are approximately as follows;

| Weight Ratio (Surfactant Component + Non-Aqueous Solvent Component):Water | Weight Percent Water | Weight Percent Actives Surfactant | Viscosity (Pa · s) | Description |
|---|---|---|---|---|
| No Dilution | 11 | 43.67 | 0.205 | Unstructured |
| (1:0.25) | 28 | 34.94 | 0.404 | Unstructured |
| (1:0.30) | 31.5 | 33.59 | 1.064 | Unstructured |
| (1:0.35) | 34.1 | 32.35 | 97.14 | Unstructured |
| (1:0.40) | 36.4 | 31.19 | 128.8 | Structured |
| (1:0.45) | 38.6 | 30.12 | 191 | Structured |
| (1:0.50) | 40.7 | 29.11 | 215.8 | Structured |
| (1:0.75) | 49.1 | 24.95 | 104.8 | Structured |
| (1:1) | 55.5 | 21.84 | 3.58 | Unstructured |
| (1:1.25) | 68 | 19.41 | 0.056 | Unstructured |
| (1:1.5) | 74.4 | 17.47 | 0.013 | Unstructured |

In various embodiments, the combination of the surfactant component and the non-aqueous solvent component is present in a weight ratio of actives with a total amount of water of about 1:0.40, about 1:0.45, about 1:0.50, about 1:0.55, about 1:0.60, about 1:0.65, about 1:0.70, or about 1:0.75. In other embodiments, the weight ratio is about 1:0.40 to about 1:0.45, about 1:0.45 to about 1:0.50, about 1:0.50 to about 1:0.55, about 1:0.55 to about 1.060, about 1:0.6 to about 1:0.65, about 1:0.65 to about 1:0.70, about 1:0.70 to about 1:0.75, about 1:0.40 to about 1:0.50, about 1:0.45 to about 1:0.55, about 1:0.50 to about 1:0.75, about 1:0.45 to about 1:0.75, about 1:0.45 to about 1:0.50, etc. In various non-limiting embodiments, all values, both whole and fractional, between and including all of the above, are hereby expressly contemplated for use herein.

In one embodiment, the combination of the surfactant component and the non-aqueous solvent component is present in a weight ratio of actives with a total amount of water of about 1:0.40. In a related embodiment, the structured detergent composition has a viscosity of about 125 to about 130 Pa·s measured using an AR2000-EX Rheometer at a shear rate of 1.08 l/s over 5 minutes at 20° C. with a geometry cone of 40 mm, 1:59:49 degree:min:sec, and a truncation gap of 52 microns.

In another embodiment, the combination of the surfactant component and the non-aqueous solvent component is present in a weight ratio of actives with a total amount of water of about 1:0.45. In a related embodiment, the structured detergent composition has a viscosity of about 190 to about 195 Pa·s measured using an AR2000-EX Rheometer at a shear rate of 1.08 l/s over 5 minutes at 20° C. with a geometry cone of 40 mm, 1:59:49 degree:min:sec, and a truncation gap of 52 microns.

In still another embodiment, the combination of the surfactant component and the non-aqueous solvent component is present in a weight ratio of actives with a total amount of water of about 1:0.50. In a related embodiment, the structured detergent composition has a viscosity of about 215 to about 220 Pa·s measured using an AR2000-EX Rheometer at a shear rate of 1.08 l/s over 5 minutes at 20° C. with a geometry cone of 40 mm, 1:59:49 degree:min:sec, and a truncation gap of 52 microns.

In a further embodiment, the combination of the surfactant component and the non-aqueous solvent component is present in a weight ratio of actives with a total amount of water of about 1:0.75. In a related embodiment, the structured detergent composition has a viscosity of about 100 to about 105 Pa·s measured using an AR2000-EX Rheometer at a shear rate of 1.08 l/s over 5 minutes at 20° C. with a geometry cone of 40 mm, 1:59:49 degree:min:sec, and a truncation gap of 52 microns.

In one embodiment, the combination of the surfactant component and the non-aqueous solvent component is present in a weight ratio of actives with the water of about 1:0.4, the surfactant component is present in an amount of about 30 to about 32 weight percent actives based on a total weight of the structured detergent composition and the water is present in an amount of from about 35 to about 37 weight percent based on a total weight of the structured detergent composition.

In another embodiment, the combination of the surfactant component and the non-aqueous solvent component is present in a weight ratio of actives with the water of about 1:0.45, the surfactant component is present in an amount of about 29 to about 31 weight percent actives based on a total weight of the structured detergent composition, and the water is present in an amount of from about 38 to about 40 weight percent based on a total weight of the structured detergent composition.

In still another embodiment, the combination of the surfactant component and the non-aqueous solvent component is present in a weight ratio of actives with the water of about 1:0.5, the surfactant component is present in an amount of about 28 to about 30 weight percent actives based on a total weight of the structured detergent composition and the water is present in an amount of from about 40 to about 42 weight percent based on a total weight of the structured detergent composition.

In another embodiment, the combination of the surfactant component and the non-aqueous solvent component is present in a weight ratio of actives with the water of about 1:0.75, the surfactant component is present in an amount of about 24 to about 26 weight percent actives based on a total weight of the structured detergent composition and the water is present in an amount of from about 48 to about 50 weight percent based on a total weight of the structured detergent composition. In a related embodiment, the structured detergent composition has a viscosity of at least about 200 Pa·s measured using an AR2000-EX Rheometer at a shear rate of 1.08 l/s over 5 minutes at 20° C. with a geometry cone of 40 mm, 1:59:49 degree:min:sec, and a truncation gap of 52 microns.

Typically, the terminology "total amount" refers to a total amount of water present in the composition from all components, i.e., not simply water added independently from, for example, the surfactant component. An independent source of water, such as DI water, may be used to dilute the composition. This water may be independent from any water present in the composition as originating from one or more components. In other words, the composition includes water originating from the components themselves. However, to further dilute the composition, the independent water source may be used.

In various non-limiting embodiments, all values, both whole and fractional, between and including all of the above, are hereby expressly contemplated for use herein.

Viscosity

As described above, a combination of the surfactant component and the non-aqueous solvent component is present in a weight ratio of actives with a total amount of water of from about 1:0.4 to about 1:0.75 such that the structured detergent composition has a viscosity of at least about 100 Pa·s measured using an AR2000-EX Rheometer at a shear rate of 1.08 l/s over 5 minutes at 20° C. with a geometry cone of 40 mm, 1:59:49 degree:min:sec, and a truncation gap of 52 microns. In various embodiments, this viscosity is at least about 105, 110, 115, 120, 125, 130, 135, 140, 145, 150, 155, 160, 165, 170, 175, 180, 185, 190, 195, or 200, Pa·s measured using an AR2000-EX Rheometer at a shear rate of 1.081/s over 5 minutes at 20° C. with a geometry cone of 40 mm, 1:59:49 degree:min:sec, and a truncation gap of 52 microns. The upper viscosity is not particularly limited and may be chosen by one of skill in the art. In various embodiments, the upper viscosity is about 200, 225, 250, 300, 350, 400, 450, 500, 750, 1000, 1250, 1500, etc., Pa·s measured using an AR2000-EX Rheometer at a shear rate of 1.08 l/s over 5 minutes at 20° C. with a geometry cone of 40 mm, 1:59:49 degree:min:sec, and a truncation gap of 52 microns. In various non-limiting embodiments, all values, both whole and fractional, between and including all of the above, are hereby expressly contemplated for use herein.

For purposes of this disclosure, a viscosity of less than about 100, e.g. 95 or less, Pa·s measured using an AR2000-EX Rheometer at a shear rate of 1.08 l/s over 5 minutes at 20° C. with a geometry cone of 40 mm, 1:59:49 degree:min:sec, and a truncation gap of 52 microns, is considered to be such that the detergent composition is unstructured.

A composition that has a viscosity of at least about 100 Pa·s measured using an AR2000-EX Rheometer at a shear rate of 1.08 l/s over 5 minutes at 20° C. with a geometry cone of 40 mm, 1:59:49 degree:min:sec, and a truncation gap of 52 microns, can be described as structured. Similarly, a detergent composition that is unstructured, or has a viscosity of less than about 100, e.g. 95 or less, Pa·s measured using an AR2000-EX Rheometer at a shear rate of 1.08 l/s over 5 minutes at 20° C. with a geometry cone of 40 mm, 1:59:49 degree:min:sec, and a truncation gap of 52 microns, can be described as unstructured.

In one embodiment, maximum viscosity increase, or structuring, is observed when a combination of the surfactant component and the non-aqueous solvent component is present in a weight ratio of actives with a total amount of water of about 1:0.50. However, even further increases may be observed when such a ratio is from about 1:0.50 to about 1:0.75. At these ratios, particularly special unexpected results are observed.

The viscosity may be alternatively measured using a Brookfield viscometer and any one or more spindles, as is chosen by one of skill in the art. In various embodiments, the composition has one or more of the aforementioned viscosities measured using a DV2T Brookfield viscometer at 20 rpm and 70° F. using spindle LV02(62). In various non-limiting embodiments, all values, both whole and fractional, between and including all of the above, are hereby expressly contemplated for use herein.

Non-Aqueous Solvent Component

The detergent composition and/or structured detergent composition also includes a non-aqueous solvent component. The non-aqueous solvent component may include or be a single non-aqueous solvent or two or more non-aqueous solvents. The amount of the non-aqueous solvent component is not particularly limited. In various embodiments, the non-aqueous solvent component is present in an amount of from about 1 to about 40, about 5 to about 35, about 10 to about 30, about 15 to about 25, about 25 to about 30, about 25 to about 35, about 30 to about 40, about 35 to about 40, or about 15 to about 20, weight percent actives based on a total weight of the composition. In various non-limiting embodiments, all values, both whole and fractional, between and including all of the above, are hereby expressly contemplated for use herein.

The non-aqueous solvent that is or is part of the non-aqueous solvent component is not particularly limited and may be any known in the art. In various embodiments, the non-aqueous solvent is chosen from monoethanolamine, glycerine, propylene glycol, and combinations thereof. In one embodiment, the non-aqueous solvent is monoethanolamine. In another embodiment, the non-aqueous solvent is glycerine. In a further embodiment, the non-aqueous solvent is propylene glycol.

In other embodiments, the non-aqueous solvent is chosen from glycerol (glycerin), propylene glycol, ethylene glycol, ethanol, and 4C+compounds. The term "4C+ compound" refers to one or more of: polypropylene glycol; polyethylene glycol esters such as polyethylene glycol stearate, propylene glycol laurate, and/or propylene glycol palmitate; methyl ester ethoxylate; diethylene glycol; dipropylene glycol; tetramethylene glycol; butylene glycol; pentanediol; hexylene glycol; heptylene glycol; octylene glycol; 2-methyl, 1,3 propanediol; triethylene glycol; polypropylene glycol; glycol ethers, such as ethylene glycol monobutyl ether, diethylene glycol monobutyl ether, triethylene glycol monobutyl ether, ethylene glycol monopropyl ether, diethylene glycol monoethyl ether, triethylene glycol monoethyl ether, diethylene glycol monomethyl ether, and triethylene glycol monomethyl ether; tris (2-hydroxyethyl)methyl ammonium methylsulfate; ethylene oxide/propylene oxide copolymers with a number average molecular weight of 3,500 Daltons or less; and ethoxylated fatty acids. In other embodiments, the non-aqueous solvent is a relatively low molecular weight polyethylene glycol (PEG) having a weight average molecular weight of less than about 600 Da, e.g. about 400, such as those having a weight average molecular weight of from about 380 to about 420, Da. In other embodiments, PEG 200, PEG 250, PEG 300, PEG 350, PEG 400, PEG 450, PEG 500, PEG 550, and/or PEG 600 (wherein the numerals represent the approximate weight average molecular weight in Daltons) may be used. Other suitable non-aqueous solvents include ethylene oxide/propylene oxide block co-polymers. In various non-limiting embodiments, all values, both whole and fractional, between and including all of the above, are hereby expressly contemplated for use herein.

Free of Added Rheology Modifier

The detergent composition and/or structured detergent composition is also free of an added rheology modifier. The terminology "free of" can describe an amount of added rheology modifier of less than 0.1, less than 0.05, or less than 0.01, weight percent actives of the added rheology modifier based on a total weight of the detergent composition and/or structured detergent composition, unless specified otherwise. In preferred embodiments, the detergent composition and/or structured detergent composition includes zero weight percent (0% wt) actives of the added rheology modifier. In various non-limiting embodiments, all values, both whole and fractional, between and including all of the above, are hereby expressly contemplated for use herein.

The terminology "added" rheology modifier is used because, some components in the surfactant system, such as one or more of the surfactants of the surfactant component, may modify the rheology of the detergent composition and/or structured detergent composition to some extent. Therefore, the term "added" is used to make it clear that the detergent composition and/or structured detergent composition is free of rheology modifiers that are not part of the surfactant system described above.

The detergent composition and/or structured detergent composition may be free of any one or more optional compounds described herein.

The terminology "rheology modifier" describes any one or more compounds known in the art to increase or decrease viscosity or rheology of detergent compositions and/or structured detergent compositions. In various embodiments, the detergent composition and/or structured detergent composition is free of an added rheology modifier that is chosen from salts, alkoxylated polyethyleneimines, polyethylene glycol, ionic liquids, and combinations thereof.

In one embodiment, the detergent composition and/or structured detergent composition is free of an added rheology modifier that is a salt, such sodium chloride and/or sodium citrate. Such salt is known to increase viscosity or rheology of a detergent composition. For clarity, the terminology "free of a salt" describes that in a detergent composition, the total amount of the salt, is less than 0.1, less than 0.05, less than 0.01, or 0 weight percent, based on a total weight of the detergent composition and/or structured detergent composition.

In another embodiment, the detergent composition and/or structured detergent composition is free of an added rheology modifier that is chosen from alkoxylated polyethyleneimines, polyethylene glycol, ionic liquids, and combinations thereof. It is known that alkoxylated polyethyleneimines, polyethylene glycol, ionic liquids, and combinations thereof would decrease viscosity or rheology of a detergent composition.

In still another embodiment, the detergent composition and/or structured detergent composition is free of an added rheology modifier that is an alkoxylated polyethyleneimine. For clarity, the terminology "free of an alkoxylated polyethyleneimine" describes that in a detergent composition, the total amount of the alkoxylated polyethyleneimine, is less than 0.1, less than 0.05, less than 0.01, or 0 weight percent, based on a total weight of the detergent composition and/or structured detergent composition.

In another embodiment, the detergent composition and/or structured detergent composition is free of an added rheology modifier that is polyethylene glycol. For clarity, the terminology "free of polyethylene glycol" describes that in a detergent composition, the total amount of polyethylene glycol, is less than 0.1, less than 0.05, less than 0.01, or 0 weight percent, based on a total weight of the detergent composition and/or structured detergent composition.

In another embodiment, the detergent composition and/or structured detergent composition is free of an added rheology modifier that is an ionic liquid. For clarity, the terminology "free of an ionic liquid" describes that in a detergent composition, the total amount of the ionic liquid, is less than 0.1, less than 0.05, less than 0.01, or 0 weight percent, based on a total weight of the detergent composition and/or structured detergent composition.

In some embodiments, the detergent composition and/or structured detergent composition that is free of a salt may contain alkoxylated polyethyleneimines, polyethylene glycol, ionic liquids, and combinations thereof.

In an embodiment, the detergent composition and/or structured detergent composition is free of a salt and also free of alkoxylated polyethyleneimines, polyethylene glycol, ionic liquids, or combinations thereof.

The detergent composition and/or structured detergent composition that is free of salt may be described as a salt-free system.

Additives

The detergent composition and/or structured detergent composition may include one or more of the following additives or may be free of one or more of the following additives. For example, the detergent composition and/or structured detergent composition may include one or more foam inhibitors (e.g. defoaming agents). Suitable foam inhibitors include, but are not limited to, fatty acids such as coconut fatty acids. The detergent composition and/or structured detergent composition may include the foam inhibitor at an amount of from about 0 to about 10 weight percent, based on the total weight of the detergent composition and/or structured detergent composition. In various non-limiting embodiments, all values, both whole and fractional, between and including all of the above, are hereby expressly contemplated for use herein.

Bittering agents may optionally be added to hinder accidental ingestion of the detergent composition and/or structured detergent composition. Bittering agents are compositions that taste bad, so children or others are discouraged from accidental ingestion. Exemplary bittering agents include denatonium benzoate, aloin, and others. Bittering agents may be present in the composition at an amount of from about 0 to about 1 weight percent, or an amount of from about 0 to about 0.5 weight percent, or an amount of from about 0 to about 0.1 weight percent in various embodiments, based on the total weight of the detergent composition and/or structured detergent composition. In various non-limiting embodiments, all values, both whole and fractional, between and including all of the above, are hereby expressly contemplated for use herein.

In other embodiments, additives may be or include neutralizers/pH adjustors just as monoethanolamine and the like, enzymes, optical brighteners, chelators, and combinations thereof. These additives may be chosen from any known in the art.

Weight Percents/Ratios of Various Components

The surfactant component, water, and non-aqueous solvent component are generally present in amounts within the weight ranges set forth above. However, in additional embodiments, these weight ranges may be narrower and/or specific weight ratios may be utilized. These weight ranges and/or ratios may be representative of embodiments that produce special, superior, and unexpected results, such as those demonstrated in the Examples. Relative to all of the paragraphs set forth immediately below, in various non-limiting embodiments, all values, both whole and fractional, between and including all of the above, are hereby expressly contemplated for use herein.

In various embodiments, the alcohol ethoxy sulfate is sodium laureth sulfate ethoxylated with about 2 to about 4 moles of ethylene oxide and is present in an amount of from about 14 to about 16 weight percent actives based on a total weight of the structured detergent composition, the linear alkyl benzene sulfonate is present in an amount of from about 4 to about 6 weight percent actives based on a total weight of the structured detergent composition, and the alcohol is a $C_{12}$-$C_{15}$ alcohol ethoxylated with about 6 to about 8 moles of ethylene oxide and is present in an amount of from about 20 to about 25 weight percent actives based on a total weight of the structured detergent composition. Moreover, in this embodiment, the non-aqueous solvent component includes glycerine present in an amount of from about 15 to about 20 weight percent based on a total weight of the structured detergent composition, propylene glycol present in an amount of from about 7 to about 10 weight percent based on a total weight of the structured detergent composition, monoethanolamine present in an amount of from about 2 to about 4 weight percent based on a total weight of the structured detergent composition, and coconut oil fatty acid present in an amount of about 9 to about 11 weight percent based on a total weight of the structured detergent composition.

In still other embodiments, any one or more of the components set forth below may be present in an amount set forth below, relative to weight percent actives based on a total weight of the detergent composition and/or structured detergent composition. All weights are approximate.

| Component | Non-Limiting Options |
|---|---|
| Non-Aqueous Solvent Component | 20-35 wt %; preferably 25-35 wt %; more preferably 25-30 wt % |
| Glycerine | 10-20 wt %, preferably 14-18 wt %; more preferably 14-16 wt % |
| Propylene Glycol | 5-12 wt %; preferably 5-10 wt %; more preferably 8-10 wt % |
| Monethanolamine | 1-5 wt %; preferably 2-5 wt %; more preferably 3-5 wt % |
| C12-C15 Alcohol Ethoxylate; 7EO | 7-30 wt %; preferably 20-30 wt %; more preferably 20-25 wt % |

-continued

| Component | Non-Limiting Options |
|---|---|
| Zeolite Water | 1-10 wt %; preferably 2-8 wt %, more preferably 4-6 wt % |
| 2-Phenyl Sulfonic Acid (LAS) | 1-10 wt %; preferably 2-8 wt %; more preferably 4-6 wt % |
| Coconut Oil Fatty Acid | 5-20 wt %; preferably 5-15 wt %; more preferably 8-12 wt % |
| Sodium C12-C14 Alcohol Ethoxysulfate 3EO; ~60% Actives | 15-30 wt %; preferably 20-30 wt %; more preferably 24-28 wt % (Weight of Actives + Water) |

Additional Embodiments

In another embodiment, the disclosure provides a structured detergent composition that includes a surfactant component including an alcohol ethoxy sulfate having a $C_8$-$C_{20}$ backbone that is ethoxylated with from about 1 to about 10 moles of ethylene oxide and is present in an amount of from about 5 to about 20 weight percent actives based on a total weight of the structured detergent composition, a linear alkyl benzene sulfonate present in an amount of from about 1 to about 10 weight percent actives based on a total weight of the structured detergent composition, and a $C_8$-$C_{20}$ alcohol alkoxylated with about 2 to about 12 moles of an alkylene oxide and present in an amount of from about 7 to about 30 weight percent actives based on a total weight of the structured detergent composition, water, and a non-aqueous solvent component, wherein the structured detergent composition is free of an added rheology modifier, and wherein the combination of the surfactant component and the non-aqueous solvent component is present in a weight ratio of actives with a total amount of water of from about 1:0.4 to about 1:0.75 such that the structured detergent composition has a viscosity of at least about 100 Pa·s measured using an AR2000-EX Rheometer at a shear rate of 1.08 1/s over 5 minutes at 20° C. with a geometry cone of 40 mm, 1:59:49 degree:min:sec, and a truncation gap of 52 microns.

In still other non-limiting embodiments, it is contemplated that the structured or unstructured detergent composition may include any one or more components or be formed or manipulated using any one or more steps, as is described in US 2018/0216034, which is expressly incorporated herein by reference in its entirely relative to these non-limiting embodiments.

Unit Dose System

This disclosure also provides a unit dose system. This system includes the unit dose pack and the detergent composition or structured detergent composition. This system may be described as a salt-free unit dose system.

Method of Forming Unit Dose Pack

This disclosure also provides a method of forming the unit dose pack. The composition is typically first formed, e.g. using shear mixing. Shear mixing may be conducted using an over-the-head mixer such as an IKA RW 20 Digital Mixer at 500 rpm. The composition may then be encapsulated within a pouch by depositing the composition within the pouch. The pouch may then be sealed to encase and enclose the composition within the pouch to form the unit dose pack. The composition is typically in direct contact with the film of the pouch within the unit dose pack. The film of the pouch is typically sealable by heat, heat and water, ultrasonic methods, or other techniques, and one or more sealing techniques may be used to enclose the composition within the pouch.

Method of Forming the Structured Detergent Composition

This disclosure further provides a method of forming the structured detergent composition. The method includes the step of combining the surfactant component, water, and the non-aqueous solvent component, and optionally any additional solvents, surfactants, additives, etc., to form the structured detergent composition. Each of the aforementioned components may be combined in any order and in whole or partial amounts. Moreover, any of the aforementioned additives may be combined as well with one or more of the aforementioned components. All orders of addition are hereby expressly contemplated for use in various non-limiting embodiments.

Method for Modifying Rheology of the Structured Detergent Composition

As first introduced above, this disclosure further provides a method for modifying rheology of the structured detergent composition. The method begins with an unstructured detergent composition that is then structured through the addition of water to the appropriate weight ratio. In other words, the addition of the water structures the composition.

The method includes the steps of providing a detergent composition comprising a surfactant component comprising an alcohol ethoxy sulfate having a $C_8$-$C_{20}$ backbone that is ethoxylated with from about 1 to about 10 moles of ethylene oxide and is present in an amount of from about 5 to about 20 weight percent actives based on a total weight of the detergent composition, a linear alkyl benzene sulfonate present in an amount of from about 1 to about 10 weight percent actives based on a total weight of the detergent composition, and a $C_8$-$C_{20}$ alcohol alkoxylated with about 2 to about 12 moles of an alkylene oxide and present in an amount of from about 7 to about 30 weight percent actives based on a total weight of the detergent composition, water, and a non-aqueous solvent component, wherein the detergent composition is free of an added rheology modifier. The method also includes the step of diluting the detergent composition with additional water such that a combination of the surfactant component and the non-aqueous solvent component is present in a weight ratio of actives with a total amount of water of from about 1:0.4 to about 1:0.75 such that the detergent composition is structured and has a viscosity of at least about 100 Pa·s measured using an AR2000-EX Rheometer at a shear rate of 1.08 l/s over 5 minutes at 20° C. with a geometry cone of 40 mm, 1:59:49 degree:min:sec, and a truncation gap of 52 microns. The step of diluting may be further defined as adding additional water to the detergent composition such as from the independent source of DI water described above, to a desired dilution weight ratio. The step of diluting may be accomplished as a batch or continuous operation.

Examples

A masterbatch composition, as set forth below in Table 1 below, is used to form a series of compositions both representative of embodiments of this disclosure (Inventive) and comparative (Comparative). All values set forth in Table 1 are in approximate parts by total weight (not actives) per 100 parts by weight of the Compositions. More specifically, the total weight of the masterbatch composition is 100 parts. The masterbatch composition is then diluted in varying weight ratios with additional amounts of D1 water, as set forth below, and evaluated to determine viscosity. The compositions are also evaluated to determine pack height, which is indicative of the interaction of the compositions with the polyvinyl alcohol single dose packs.

TABLE 1

| Masterbatch Composition | Parts by Total |
|---|---|
| Glycerine (99% + Actives) | 15.92 |
| C12-C15 Alcohol Ethoxylate 7EO (99% + Actives) | 23.07 |
| Propylene Glycol (99% + Actives) | 8.20 |
| Monethanolamine (99% + Actives) | 3.15 |
| Zeolite Water | 4.57 |
| 2-Phenyl Sulfonic Acid (LAS) (99% + Actives) | 5.00 |
| Coconut Oil Fatty Acid (99% + Actives) | 10.00 |
| Sodium C12-C14 Alcohol Ethoxysulfate; 3EO (~60% Actives) | 26.00 |
| Bitrex (~25% Actives) | 0.05 |
| Enzyme (~8% Actives) | 2.50 |
| Optical brightener (99% + Actives) | 0.20 |
| Sodium Sulfite, 15% sol'n (15% Actives) | 1.33 |

In Table 1 above, the components are as follows:

C12-C15 Alcohol Ethoxylate-7 E/O is a $C_{12}$-$C_{15}$ Alcohol Ethoxylate that is capped with approximately 7 moles of ethylene oxide.

Sodium C12-C14 Alcohol Ethoxysulfate; 3EO is a $C_{12}$-$C_{14}$ alcohol ethoxy sulfate that is capped with 3 moles of ethylene oxide.

Bitrex is a bittering additive, which is a 25% active solution in water.

Enzyme is a commercially available protease.

Optical Brightener is Tinopal CBS-X Swiss.

The aforementioned Masterbatch Composition is used to form the following Compositions 1-11. The Compositions 1-11 are evaluated to determine viscosity using an AR2000-EX Rheometer at a shear rate of 1.08 l/s over 5 minutes at 20 with geometry cone of 4 mm, 1:59:49 degree:min:sec, and truncation gap of 52 microns. The results of these evaluations are set forth in Table 2 below and in FIG. 1, wherein viscosity is set forth as Pa. S.

TABLE 2

| Composition | Dilution Ratio (Detergent:Water) | Percent Water | Percent Actives of Surfactant | Viscosity (Pa · s) | Physical State | Characters |
|---|---|---|---|---|---|---|
| Comparative Composition 1 | Control Formula; No Dilution | 11 | 43.67 | 0.205 | Liquid | Unstructured |
| Comparative Composition 2 | (1:0.25) | 28 | 34.94 | 0.404 | Liquid | Unstructured |
| Comparative Composition 3 | (1:0.30) | 31.5 | 33.59 | 1.064 | Liquid | Unstructured |
| Comparative Composition 4 | (1:0.35) | 34.1 | 32.35 | 97.14 | Partially Viscous | Partially Structured |
| Inventive Composition 5 | (1:0.40) | 36.4 | 31.19 | 128.8 | Viscous | Structured |

TABLE 2-continued

| Composition | Dilution Ratio (Detergent:Water) | Percent Water | Percent Actives of Surfactant | Viscosity (Pa · s) | Physical State | Characters |
|---|---|---|---|---|---|---|
| Inventive Composition 6 | (1:0.45) | 38.6 | 30.12 | 191 | Viscous | Structured |
| Inventive Composition 7 | (1:0.50) | 40.7 | 29.11 | 215.8 | Viscous | Structured |
| Inventive Composition 8 | (1:0.75) | 49.1 | 24.95 | 104.8 | Viscous | Structured |
| Comparative Composition 9 | (1:1) | 55.5 | 21.84 | 3.58 | Liquid | Unstructured |
| Comparative Composition 10 | (1:1.25) | 68 | 19.41 | 0.056 | Liquid | Unstructured |
| Comparative Composition 11 | (1:1.5) | 74.4 | 17.47 | 0.013 | Liquid | Unstructured |

The data shows that at small dilution ratios, e.g. from zero to 1:0.30, the viscosity of the Comparative Compositions 1-3 remains very low. In other words, these Compositions are not structured and remain very thin/liquid. Once the dilution ratio reaches 1:0.35, the Comparative Composition 4 begins to somewhat or partially become viscous. However, the viscosity of about 97.14 Pa·s is not considered by those of skill in the art to be structured. However, once the dilution ratio reaches 1:0.40, the Inventive Composition 5 becomes structured, as evidenced by the viscosity of about 128.8 Pa·s. This behavior continues to be observed at ratios of 1:0.45; 1:0.50; and 1:0.75 for Inventive Compositions 6-8, respectively. The viscosity appears to maximize at the dilution ratio of about 1:0.50 with Inventive Composition 7. Upon dilution with additional water, the viscosity begins to decrease, e.g. at a dilution ratio of 1:0.75. At this dilution ratio, the viscosity is about 104.7 Pa·s, which is still considered by those of skill in the art to viscous such that the Inventive Composition 8 is structured. However, upon additional dilution with water, e.g. starting at a ratios of about 1:1 and continuing at ratios of about 1:1.25 to 1:1.5 in Comparative Compositions 9-11, respectively, the viscosity decreases significantly such that these Compositions are not structured and are very thin/liquid.

Accordingly, it is clear to those of skill in the art that the results associated with Inventive Compositions 5-8 are superior to, and unexpected over, what would otherwise be predicted by those of skill in the art. Those of skill in the art would not expect that a combination of the surfactant component and the non-aqueous solvent component present in a weight ratio of actives with a total amount of water of from about 1:0.4 to about 1:0.75 would structure the detergent compositions, while both smaller and larger weight ratios would not allow the detergent compositions to structure.

Figure 2:
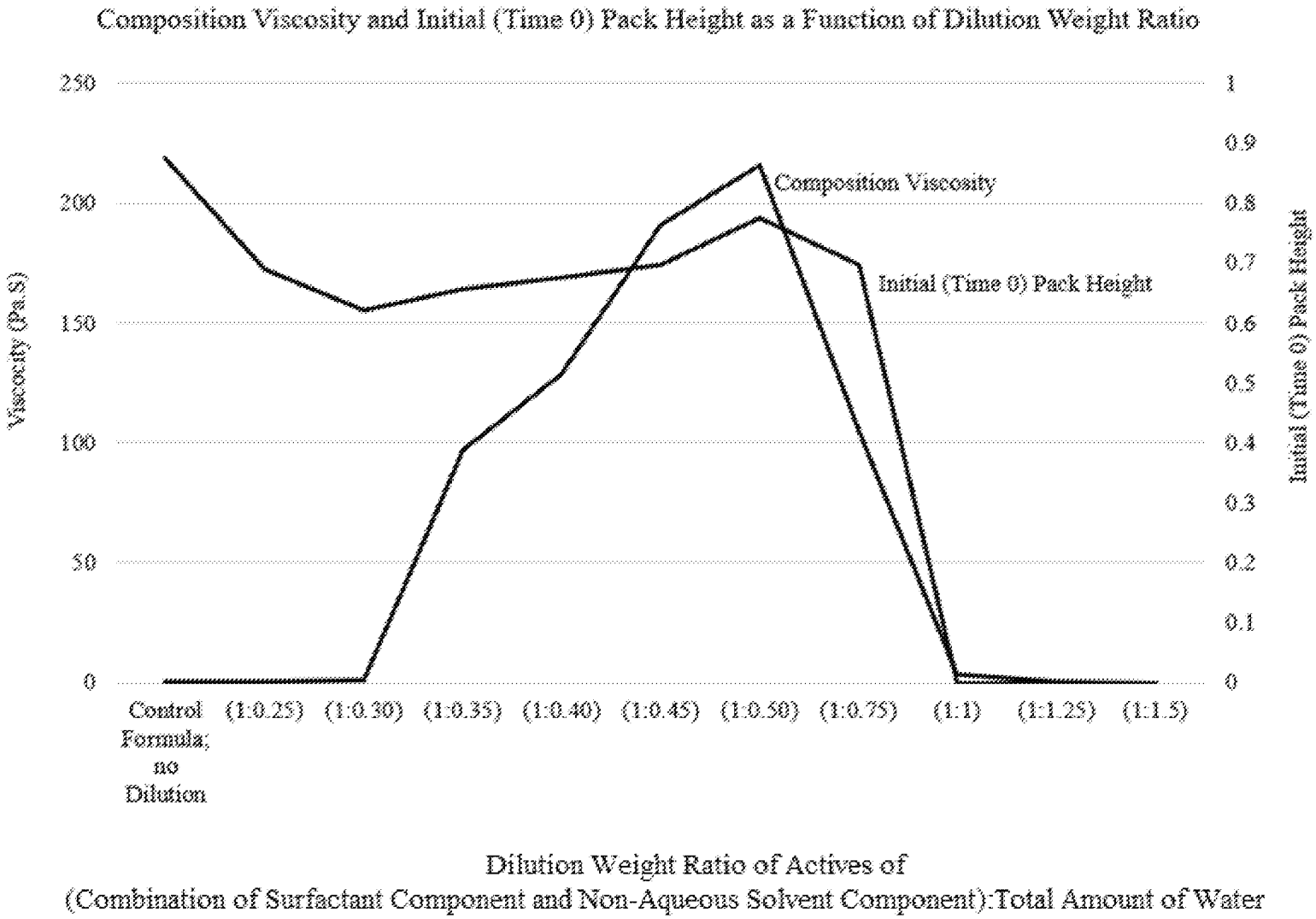
FIG. 2 is a line graph of Composition Viscosity and Initial (Time 0) Pack Height as a Function of Dilution Weight Ratio of Actives of a (Combination of the Surfactant Component and the Non-Aqueous Solvent Component):Total Amount of Water, as also set forth in the Examples.

The Compositions 1-11 were also evaluated to determine Pack Height, as set forth in Table 3 below and in FIG. 2. Pack Height (inches) refers to data measured after the packs rested for 1 hr. at 25° C. after formation. The packs are formed using 20 g of one of the Compositions 1-11 encapsulated in Monosol M8312 film that is 76 microns thick. The height of the pack is indicative of how much the pack has softened, broken down, plasticized, and/or dissolved as a result of the Compositions disposed therein. A pack with no softening, break down, etc. has a higher pack height and is firm to the touch. A pack with softening and break down begins to sag and is soft to the touch. Therefore, higher pack heights are indicative of less breakdown of the film and are preferred.

TABLE 3

| Composition | Dilution Ratio (Detergent:Water) | Percent Water | Percent Actives of Surfactant | Viscosity (Pa · s) | Time 0 Pack Height (Inches) | Decrease in Initial Pack Height vs. Control (%) |
|---|---|---|---|---|---|---|
| Comparative Composition 1 | Control Formula; No Dilution | 11 | 43.67 | 0.205 | 0.88 | — |
| Comparative Composition 2 | (1:0.25) | 28 | 34.94 | 0.404 | 0.698 | 21.2% |
| Comparative Composition 3 | (1:0.30) | 31.5 | 33.59 | 1.064 | 0.628 | 29.0% |
| Comparative Composition 4 | (1:0.35) | 34.1 | 32.35 | 97.14 | 0.66 | 25.1% |
| Inventive Composition 5 | (1:0.40) | 36.4 | 31.19 | 128.8 | 0.68 | 22.8% |
| Inventive Composition 6 | (1:0.45) | 38.6 | 30.12 | 191 | 0.70 | 20.4% |
| Inventive Composition 7 | (1:0.50) | 40.7 | 29.11 | 215.8 | 0.77 | 11.6% |
| Inventive Composition 8 | (1:0.75) | 49.1 | 24.95 | 104.8 | 0.70 | 20.4% |
| Comparative Composition 9 | (1:1) | 55.5 | 21.84 | 3.58 | Product Unstable | N/A |
| Comparative Composition 10 | (1:1.25) | 68 | 19.41 | 0.056 | Product Unstable | N/A |

TABLE 3-continued

| Composition | Dilution Ratio (Detergent:Water) | Percent Water | Percent Actives of Surfactant | Viscosity (Pa · s) | Time 0 Pack Height (Inches) | Decrease in Initial Pack Height vs. Control (%) |
|---|---|---|---|---|---|---|
| Comparative Composition 11 | (1:1.5) | 74.4 | 17.47 | 0.013 | Product Unstable | N/A |

Comparative Composition 1 provides a control for Pack Height of 0.876 inches. This is considered to bean approximate maximum that is indicative of minimal softening, breakdown, plasticization, and/or dissolution.

Comparative Compositions 24 and 8 produce a reduction in Pack Height of about 20-29%. This is indicative of more pronounced softening, breakdown, plasticization, and/or dissolution.

Inventive Compositions 5-8 produce a reduction in Pack Height of about 11-23. This is considered by those of skill in the art to be a significant improvement as compared to the reduction in Pack Heights produced by Comparative Compositions 2-4 and 8. In other words, the Inventive Compositions 5-8 minimize the softening, breakdown, plasticization, and/or dissolution produced by Comparative Compositions 2-4 and 8. Accordingly, the results produced by Inventive Compositions 5-8 are surprising, unexpected over, and superior to, the results produced by Comparative Compositions 2-4 and 8.

Moreover, Comparative Compositions 9-11 did not allow for stable packs to be formed such that pack height could not be evaluated. In other words, the films used to form packs that included Comparative Compositions 9-11 dissolved and/or broke down before viable packs could be formed. Therefore, such packs are not useable or suitable for pack height measurements. Accordingly, the Inventive Compositions 5-8 are far superior in this regard.

While at least one exemplary embodiment has been presented in the foregoing detailed description, it should be appreciated that a vast number of variations exist. It should also be appreciated that the exemplary embodiment or exemplary embodiments are only examples, and are not intended to limit the scope, applicability, or configuration in any way. Rather, the foregoing detailed description will provide those skilled in the art with a convenient road map for implementing an exemplary embodiment. It should be understood that various changes may be made in the function and arrangement of elements described in an exemplary embodiment without departing from the scope as set forth in the appended claims.

What is claimed is:

1. A unit dose detergent pack comprising:

a pouch made of a water-soluble film; and a structured detergent composition encapsulated within said pouch, wherein said structured detergent composition comprises:

A. a surfactant component comprising, (i) an alcohol ethoxy sulfate having a $C_8$-$C_{20}$ backbone that is ethoxylated with from about 1 to about 10 moles of ethylene oxide and is present in an amount of from about 5 to about 20 weight percent actives based on a total weight of said structured detergent composition, (ii) a linear alkyl benzene sulfonate present in an amount of from about 1 to about 10 weight percent actives based on a total weight of said structured detergent composition, and (iii) a $C_8$-$C_{20}$ alcohol alkoxylated with about 2 to about 12 moles of an alkylene oxide and present in an amount of from about 7 to about 30 weight percent actives based on a total weight of said structured detergent composition, B. water,and C. a non-aqueous solvent component, wherein said structured detergent composition is free of an added rheology modifier; and wherein a combination of said surfactant component and said non-aqueous solvent component is present in a weight ratio of actives with a total amount of water of from about 1:0.4 to about 1:0.75 such that said structured detergent composition has a viscosity of at least about 100 Pa.s;

wherein said water is present in an amount of from about 48 to about 50 weight percent based on a total weight of said structured detergent composition.

2. The unit dose detergent pack of claim 1 wherein said added rheology modifier is chosen from salts, alkoxylated polyethyleneimines, polyethylene glycol, ionic liquids, and combinations thereof.

3. The unit dose detergent pack of claim 1 wherein said added rheology modifier is a salt.

4. The unit dose detergent pack of claim 3 wherein said salt is sodium chloride and/or sodium citrate.

5. The unit dose detergent pack of claim 1 wherein said added rheology modifier is chosen from alkoxylated polyethyleneimines, polyethylene glycol, ionic liquids, and combinations thereof.

6. The unit dose detergent pack of claim 1 wherein said combination of said surfactant component and said non-aqueous solvent component is present in a weight ratio of actives with said water of about 1:0.4.

7. The unit dose detergent pack of claim 6 wherein said surfactant component is present in an amount of about 30 to about 32 weight percent actives based on a total weight of said structured detergent composition.

8. The unit dose detergent pack of claim 1 wherein the non-aqueous solvent component is not alkoxylated polyethyleneimines, polyethylene glycol, ionic liquids, or combinations thereof.

9. The unit dose detergent pack of claim 1 wherein said combination of said surfactant component and said non-aqueous solvent component is present in a weight ratio of actives with said water of about 1:0.5.

10. The unit dose detergent pack of claim 9 wherein said surfactant component is present in an amount of about 28 to about 30 weight percent actives based on a total weight of said structured detergent composition.

11. The unit dose detergent pack of claim 1 wherein said combination of said surfactant component and said non-aqueous solvent component is present in a weight ratio of actives with said water of about 1:0.75.

12. The unit dose detergent pack of claim 1 wherein said surfactant component is present in an amount of about 24 to about 26 weight percent actives based on a total weight of said structured detergent composition.

13. The unit dose detergent pack of claim 1 wherein said structured detergent composition has a viscosity of at least about 200 Pa.s.

14. The unit dose detergent pack of claim 1 that has a pack height that is at least about 77% of the height of a pack.

15. The unit dose detergent pack of claim 1 wherein:

A. (i) said alcohol ethoxy sulfate is sodium laureth sulfate ethoxylated with about 2 to about 4 moles of ethylene oxide and is present in an amount of from about 14 to about 16 weight percent actives based on a total weight of said structured detergent composition, (ii) said linear alkyl benzene sulfonate is present in an amount of from about 4 to about 6 weight percent actives based on a total weight of said structured detergent composition, and (iii) said alcohol is a $C_{12}$-$C_{15}$ alcohol ethoxylated with about 6 to about 8 moles of ethylene oxide and is present in an amount of from about 20 to about 25 weight percent actives based on a total weight of said structured detergent composition, B. water; and C. said non-aqueous solvent component comprises glycerine present in an amount of from about 15 to about 20 weight percent based on a total weight of said structured detergent composition, propylene glycol present in an amount of from about 7 to about 10 weight percent based on a total weight of said structured detergent composition, and monoethanolamine present in an amount of from about 2 to about 4 weight percent based on a total weight of said structured detergent composition, wherein said structured detergent composition further comprises coconut oil fatty acid present in an amount of about 9 to about 11 weight percent based on a total weight of said structured detergent composition, and wherein said combination of said surfactant component and said non-aqueous solvent component is present in a weight ratio of actives with a total amount of water of about 1:0.5 such that said structured detergent composition has a viscosity of at least about 200 Pa.s.

16. A structured detergent composition comprising:

A. a surfactant component comprising, (i) an alcohol ethoxy sulfate having a $C_8$-$C_{20}$ backbone that is ethoxylated with from about 1 to about 10 moles of ethylene oxide and is present in an amount of from about 5 to about 20 weight percent actives based on a total weight of said structured detergent composition, (ii) a linear alkyl benzene sulfonate present in an amount of from about 1 to about 10 weight percent actives based on a total weight of said structured detergent composition, and (iii) a $C_8$-$C_{20}$ alcohol alkoxylated with about 2 to about 12 moles of an alkylene oxide and present in an amount of from about 7 to about 30 weight percent actives based on a total weight of said structured detergent composition;

B. water present in an amount of from about 48 to about 50 weight percent based on a total weight of said structured detergent composition; and C. a non-aqueous solvent component, wherein said structured detergent composition is free of an added rheology modifier; and wherein said combination of said surfactant component and said non-aqueous solvent component is present in a weight ratio of actives with a total amount of water of from about 1:0.4 to about 1:0.75 such that said structured detergent composition has a viscosity of at least about 100 Pa.s.

17. A method for modifying rheology of a detergent composition, said method comprising the steps of:

providing a detergent composition comprising;

A. a surfactant component comprising, (i) an alcohol ethoxy sulfate having a $C_8$-$C_{20}$ backbone that is ethoxylated with from about 1 to about 10 moles of ethylene oxide and is present in an amount of from about 5 to about 20 weight percent actives based on a total weight of the detergent composition, (ii) a linear alkyl benzene sulfonate present in an amount of from about 1 to about 10 weight percent actives based on a total weight of the detergent composition, and (iii) a $C_8$-$C_{20}$ alcohol alkoxylated with about 2 to about 12 moles of an alkylene oxide and present in an amount of from about 7 to about 30 weight percent actives based on a total weight of the detergent composition;

B. water present in an amount of from about 48 to about 50 weight percent based on a total weight of said detergent composition; and C. a non-aqueous solvent component, wherein the detergent composition is free of an added rheology modifier; and diluting the detergent composition with additional water such that a combination of the surfactant component and the non-aqueous solvent component is present in a weight ratio of actives with a total amount of water of from about 1:0.4 to about 1:0.75 such that the detergent composition is structured and has a viscosity of at least about 100 Pa.s.

18. The method of claim 1 wherein the detergent composition is encapsulated in a pouch made of a water-soluble film.

* * * * *